US009862508B2

(12) United States Patent
Eto et al.

(10) Patent No.: US 9,862,508 B2
(45) Date of Patent: Jan. 9, 2018

(54) PACKAGING AND FILLING DEVICE, PAPER CONTAINER AND BLANK

(71) Applicant: Tetra Laval Holdings & Finance S.A., Pully (CH)

(72) Inventors: Satoshi Eto, Tokyo (JP); Keiji Yano, Tokyo (JP); Hiroyoshi Kuwata, Tokyo (JP); Takashi Omiya, Tokyo (JP)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 14/981,666

(22) Filed: Dec. 28, 2015

(65) Prior Publication Data

US 2016/0114913 A1 Apr. 28, 2016

Related U.S. Application Data

(63) Continuation of application No. PCT/JP2014/067026, filed on Jun. 26, 2014.

(30) Foreign Application Priority Data

Jun. 28, 2013 (JP) ..... 2013-135963

(51) Int. Cl.
*B65B 43/10* (2006.01)
*B65B 43/14* (2006.01)
(Continued)

(52) U.S. Cl.
CPC ..... *B65B 3/02* (2013.01); *B65B 3/025* (2013.01); *B65B 43/10* (2013.01); *B65B 43/145* (2013.01);
(Continued)

(58) Field of Classification Search
CPC ..... B65B 3/02; B65B 3/025; B65B 43/185; B65B 43/10; B65B 43/225; B65B 51/10;
(Continued)

(56) References Cited

U.S. PATENT DOCUMENTS 3,280,531 A * 10/1966 Meyer-Jagenberg ... B65B 3/025 493/129
3,412,922 A 11/1968 Miller et al.
(Continued)

FOREIGN PATENT DOCUMENTS

JP 56-064943 A 6/1981
JP U 1582831 7/1984
(Continued)

OTHER PUBLICATIONS

International Search Report and Written Opinion in PCT/JP2014/067025, dated Sep. 22, 2014 (6 pages).
(Continued)

*Primary Examiner* — Hemant M Desai
*Assistant Examiner* — Mobeen Ahmed
(74) *Attorney, Agent, or Firm* — Finnegan, Henderson, Farabow, Garrett & Dunner LLP

(57) ABSTRACT

A packaging and filling device, a paper container, and a blank is disclosed. The blank comprises a sixth panel in a readily foldable state prior to a step for forming a bottom part, and provides sufficient length in a folded portion to protect the end surface of a packaging material. The blank for the paper container is formed by the packaging and filling device and comprises a top part, a bottom part, and a cylindrical body having four side walls and a square cross-section. The packaging and filling device comprises a loading unit for retrieving the blank and loading a cylindrical blank, a bottom-part-molding unit for molding the bottom part of the cylindrical blank to obtain a container, a filling unit for filling the container with liquid food from an upper opening, and an upper-part-sealing unit for heat-sealing the upper opening.

2 Claims, 6 Drawing Sheets

(51) Int. Cl.

| | |
|---|---|
| ***B65B 43/22*** | (2006.01) |
| ***B65B 3/02*** | (2006.01) |
| ***B65B 5/06*** | (2006.01) |
| ***B65B 51/10*** | (2006.01) |
| ***B65D 5/06*** | (2006.01) |
| ***B65B 43/18*** | (2006.01) |

(52) U.S. Cl.
CPC ..... *B65B 43/185* (2013.01); *B65B 43/225* (2013.01); *B65B 51/10* (2013.01); *B65D 5/067* (2013.01)

(58) Field of Classification Search
CPC ..... B65B 43/145; B65B 7/16; B65B 43/08; B65B 43/265; B65D 5/067
USPC ..... 53/563, 565, 370.2, 370.9, 371.9
See application file for complete search history.

(56) References Cited

U.S. PATENT DOCUMENTS 3,456,419 A * 7/1969 Drake ..... B65B 3/025 141/140
3,486,423 A * 12/1969 Mistarz ..... B65B 3/025 493/164
3,699,743 A * 10/1972 King ..... B65B 59/005 53/371.9
3,785,113 A * 1/1974 Martensson ..... B29C 65/7882 493/184
4,078,364 A * 3/1978 Schmidt ..... B65B 7/18 493/184
4,126,981 A * 11/1978 King ..... B29B 13/025 53/284.5
5,167,607 A * 12/1992 Larsen ..... B31B 1/00 493/183
5,324,250 A * 6/1994 Janson ..... B65B 3/025 493/133
5,517,801 A * 5/1996 Persells ..... B29C 65/08 493/183
5,536,231 A * 7/1996 Nilsson ..... B31B 1/00 493/312
6,253,994 B1 * 7/2001 Mogard ..... B29C 66/004 229/125.04
6,328,204 B1 * 12/2001 Stacy-Ryan ..... B65D 5/061 229/137
2005/0060965 A1 3/2005 Katsumata et al.
2006/0126275 A1 * 6/2006 Kortsmit ..... B65B 43/10 361/600
2007/0072756 A1 * 3/2007 Monti ..... B65B 5/024 493/309
2007/0243986 A1 * 10/2007 Anderson ..... B31B 1/00 493/175
2009/0025871 A1 * 1/2009 Ash ..... B29B 13/02 156/275.1
2011/0294637 A1 * 12/2011 Muller ..... B31B 1/00 493/23

FOREIGN PATENT DOCUMENTS

| | | | |
|---|---|---|---|
| JP | 03-182330 | A | 6/1991 |
| JP | H03-182330 | A | 8/1991 |
| JP | H06-226884 | A | 8/1994 |
| JP | H07-040971 | A | 2/1995 |
| JP | H09-226884 | A | 9/1997 |
| JP | 10-329243 | A | 12/1998 |
| JP | 2000-127260 | A | 5/2000 |
| JP | 2000-280375 | A | 10/2000 |
| JP | 2001-031018 | A | 2/2001 |
| JP | 2001-353790 | A | 12/2001 |
| JP | 2007-283766 | A | 11/2007 |

OTHER PUBLICATIONS

Extended Search Report, in application No. 14817869.2-1708 / 3015371 PCT/JP2014067026, dated Feb. 20, 2017.
Supplemental Search Report, in application No. 14817869.2-1708 / 3015371 PCT/JP2014067026, dated Feb. 20, 2017.
International Search Report in PCT/JP2014/067026, dated Sep. 22, 2014 (6 pages).

* cited by examiner

PACKAGING AND FILLING DEVICE, PAPER CONTAINER AND BLANK

CROSS-REFERENCE TO RELATED APPLICATION

This application is a continuation application of International Application No. PCT/JP2014/067026 filed on Jun. 26, 2014. The content of the prior application is herein incorporated by reference in its entirety.

TECHNICAL FIELD

The present invention relates to a packaging and filling device, a paper container and a blank for use in packaging and filling liquid food, such as milk, juices, etc. in a roofed paper container.

BACKGROUND ART

The roofed paper container filled with liquid is formed by preparing a bottomed square cylindrical container formed of a paper packaging material having a thermoplastic resinous layer provided on the outside and inside surfaces; standing the container vertically with the container bottom positioned below and the container opening positioned upper; sterilizing the inside of the container; filling a content liquid as a drink, such as milk, a juice or others through an opening in the top of the container; applying hot blast to the part-to-be-hermetically sealed of the inside of the top of the container to soften/melt the thermoplastic resinous layer; and pressing the part-to-be-hermetically sealed to hermetically seal the top opening. The series of these steps (preparing the container, standing the container, the sterilization, filling a liquid, hermetically-sealing the upper part, etc.) is performed inside the packaging/filling device.

In the above-described packaging/filling, a blank in a square cylindrical developed shape (FIG. 1(A)) is formed into a cylinder with a vertical seal, and then the bottom is folded in to form the bottom by thermal press, and the square cylindrical container is formed (FIG. 1(D)). The roofed paper container (FIG. 1(E)) is formed by the series of the above-described steps.

In the packaging and filling device, a blank of a paper container having the developed shaped and the fold lines as illustrated in FIG. 1(A) is used. The blank has a first bottom panel 1*b* and a third bottom panel 3*b* extended from the respective lower sides of a first panel 1 and a third panel 3 which correspond to one pair of 2 opposed container sidewalls; a second bottom panel bottom panel 2*b* and a fourth bottom panel 4*b* extended from the respective lower sides of a second panel 2 and a fourth panel 4 which correspond to the other pair of 2 opposed sidewalls; a fifth panel 6 extended from a part of the lower side of the third bottom panel 3*b*; and plural upper panels 1*t*, 2*t*, 3*t*, 4*t* which correspond to the top of the container. In the packaging and filling device, the prior bending mechanism is not used, and the sixth panel is bent with a bending member having 2 curved portions in the step of forming the bottom of the container after the heating step of heating to melt and soften the thermoplastic resinous layer of polyethylene or others on the inside and the outside surfaces (refer to, e.g., Patent Reference 1).

PRIOR ART REFERENCES

Patent References

Patent Reference 1: Japanese Patent Laid-Open H06-226884
Patent Reference 2: Japanese Patent Laid-Open H09-226884

Patent Reference 3: Japanese Patent Laid-Open H03-182330
Patent Reference 4: Japanese Patent Laid-Open H07-040971
Patent Reference 5: Japanese Utility Model Laid-Open S48-13058
Patent Reference 6: Japanese Utility Model Registration No. 1582831
Patent Reference 7: Japanese Utility Model Laid-Open S63-13144

SUMMARY OF THE INVENTION

Problems to be Solved by the Invention

When the sixth panel is bent with the bending member in the bottom forming step after the heating step of heating to melt and soften the polyethylene layer on the inside and the outside surfaces, the polyethylene on the inside and the outside surfaces of parts or the entire of the sixth panel is also melted and softened, and there is a risk that the polyethylene might adhere to the parts where the bending member contacts and deposit on the bending member in polyethylene masses and residues. Even when the sixth panel is bent, the bent part cannot sufficiently secure a length necessary to protect the side surface of the packaging material. To ensure the sufficient length, increasing the width of the sixth panel might cause the inconvenience that the sixth panel could not be sufficiently bent.

The present invention aims to provide a packaging/filling device, a paper container and a blank which, by the time the bottom forming step is carried out, can make the sixth panel easily bendable and ensure a sufficient length for the bent portion to protect the side surface of the packaging material.

Means for Solving the Problem

A packaging and filling device according to the present invention is characterized by the packaging and filling device for forming a paper container including a cylindrical body having 4 sidewalls and a substantially square cross section, a top and a bottom, the paper container being formed of a blank prepared by cutting a band-shaped packaging material made at least of an outermost thermoplastic layer, a paper layer and an innermost thermoplastic layer; the blank having a developed shape of the paper container and fold lines; the blank including a first bottom panel and a third bottom panel extended the respective lower sides of a first panel and a third panel which are one pair of 2 container sidewalls opposed to each other; and a second bottom panel and a fourth bottom panel extended from the respective lower sides of a second panel and a fourth panel which are the other pair of 2 container sidewalls opposed to each other; the third bottom panel having a sixth panel partially extended from the center of the lower side of the third bottom panel; the sixth panel having a width which is 15-65% of a total length of the lower side of the third bottom panel, and a height which facilitates the bending; the blank including a plurality of top panels corresponding to the top of the paper container; the bottom of the paper container being formed by bending the sixth panel outward; bending the second bottom panel and the fourth panel into triangular flaps with the lower side surfaces of the second and the fourth bottom panels faced outward and bending the second and the fourth bottom panels inward; stacking the first bottom panel and the third bottom panel on the outsides of the second bottom panel and the fourth bottom panel with the first bottom panel positioned outside of the third bottom panel, and pressing from the inside and the outside, and heat-sealing; the packaging and filling device at least including a loading means of taking out 1 out of a bundle of a plurality of blanks having vertically sealed and flatted; a bottom forming means of forming the bottom of the cylindrical blank to form the container having the top opening and the bottom; a filling means of filling liquid food through the top opening; and a top sealing means of heat-sealing the top opening; the loading means including a taking-out means which takes out the blank and has a making bendable means which bends the sixth panel outward and makes the sixth panel bendable; an erecting means of erecting the flatted blank into the cylindrical blank; and an infeeder which inserts the mandrel of the bottom forming means into the cylindrical blank with the sixth panel made bendable, the making bendable means being a sector piece provided on the shaft of a rotary roller which receives and transfers the blank taken out, and provided at a position corresponding to the sixth panel; the infeeder including a carrier which moves together with the sixth panel of the cylindrical blank, and a prior bending block fixed to a position immediately before the mandrel, and as the carrier is moved downward, the sixth panel as well following the carrier to be bent with the corners of the forward end of the prior bending block; the heating station of the bottom forming means including a nozzle surface of a heat for heating the container bottom panel, and a bending claw provided on the nozzle surface for heating the inside surface of the third bottom panel, 2 pointed claws being erected toward the third bottom panel; and the press station of the bottom forming means pressing the container bottom from the outside and the inside by the forward side surface of the mandrel and a press surface, and including a triangular emboss provided on the forward side surface of the mandrel at a position corresponding to the sixth panel and abutting a position where the third bottom panel is exposed on the inside surface of the container, whereby the sixth panel is bent, and the container bottom can be surely formed.

A paper container according to the present invention is characterized by the paper container having a cylindrical body having 4 sidewalls and a substantially square cross-section, and a top and a bottom, to be formed by a packaging and filling device, the paper container being formed of a blank prepared by cutting a band-shaped packaging material formed at least of an outermost thermoplastic layer, a paper layer and an outermost thermoplastic layer; the blank having a developed shaper of the paper container and fold lines; the blank including a first bottom panel and a third bottom panel extended the respective lower sides of a first panel and a third panel which are one pair of 2 container sidewalls opposed to each other; and a second bottom panel and a fourth bottom panel extended from the respective lower sides of a second panel and a fourth panel which are the other pair of 2 container sidewalls opposed to each other; the third bottom panel having a sixth panel partially extended from the center of the lower side of the third bottom panel; the sixth panel having a width which is 15-65% of a total length of the lower side of the third bottom panel, and a height which facilitates the bending; the blank including a plurality of top panels corresponding to the top of the paper container; the bottom of the paper container being formed by bending the sixth panel outward; bending the second bottom panel and the fourth panel into triangular flaps with the lower side surfaces of the second and the fourth bottom panels faced outward and bending the second and the fourth bottom panels inward; stacking the first bottom panel and the third bottom panel on the outsides of the second bottom panel and the fourth bottom panel with the first bottom panel positioned outside of the third bottom panel, and pressing from the inside and the outside, and heat-sealing; the packaging and filling device at least including a loading means of taking out 1 out of a bundle of a plurality of blanks having vertically sealed and flatted; a bottom forming means of forming the bottom of the cylindrical blank to form the container having the top opening and the bottom; a filling means of filling liquid food through the top opening; and a top sealing means of heat-sealing the top opening; the loading means including a taking-out means which takes out the blank and has a making bendable means which bends the sixth panel outward and makes the sixth panel bendable; an erecting means of erecting the flatted blank into the cylindrical blank; and an infeeder which inserts the mandrel of the bottom forming means into the cylindrical blank with the sixth panel made bendable, the making bendable means being a sector piece provided on the shaft of a rotary roller which receives and transfers the blank taken out, and provided at a position corresponding to the sixth panel; the infeeder including a carrier which moves together with the sixth panel of the cylindrical blank, and a prior bending block fixed to a position immediately before the mandrel, and as the carrier is moved downward, the sixth panel as well following the carrier to be bent with the corners of the forward end of the prior bending block; the heating station of the bottom forming means including a nozzle surface of a heat for heating the container bottom panel, and a bending claw provided on the nozzle surface for heating the inside surface of the third bottom panel, 2 pointed claws being erected toward the third bottom panel; and the press station of the bottom forming means pressing the container bottom from the outside and the inside by the forward side surface of the mandrel and a press surface, and including a triangular emboss provided on the forward side surface of the mandrel at a position corresponding to the sixth panel and abutting a position where the third bottom panel is exposed on the inside surface of the container, whereby the sixth panel bent is laid between the first bottom panel and the third bottom panel, and the side surfaces of the respective bottom panels and the six panel are not exposed on the inside surface of the bottom of the container.

A blank according to the present invention is characterized by the blank for a paper container having a cylindrical body having 4 sidewalls and a substantially square cross-section, and a top and a bottom to be formed by a packaging and filling device, the paper container being formed of a blank prepared by cutting a band-shaped packaging material formed at least of an outermost thermoplastic layer, a paper layer and an outermost thermoplastic layer; the blank having a developed shaper of the paper container and fold lines; the blank including a first bottom panel and a third bottom panel extended the respective lower sides of a first panel and a third panel which are one pair of 2 container sidewalls opposed to each other; and a second bottom panel and a fourth bottom panel extended from the respective lower sides of a second panel and a fourth panel which are the other pair of 2 container sidewalls opposed to each other; the third bottom panel having a sixth panel partially extended from the center of the lower side of the third bottom panel; the sixth panel having a width which is 15-65% of a total length of the lower side of the third bottom panel, and a height which facilitates the bending; the blank including a plurality of top panels corresponding to the top of the paper container; the bottom of the paper container being formed by bending the sixth panel outward, bending the second bottom panel and the fourth panel into triangular flaps with the lower side surfaces of the second and the fourth bottom panels and bending the flap inward; stacking the first bottom panel and the third bottom panel on the outsides of the second bottom panel and the fourth bottom panel with the first bottom panel positioned outside of the third bottom panel, and pressing from the inside and the outside, and heat-sealing; the packaging and filling device at least including a loading means of taking out 1 out of a bundle of a plurality of blanks having vertically sealed and flatted; a bottom forming means of forming the bottom of the cylindrical blank to form the container having the top opening and the bottom; a filling means of filling liquid food through the top opening; and a top sealing means of heat-sealing the top; the loading means including a taking-out means which takes out the blank and has a making bendable means which bends the sixth panel outward and makes the sixth panel bendable; an erecting means of erecting the flatted blank into the cylindrical blank; and an infeeder which inserts the mandrel of the bottom forming means into the cylindrical blank with the sixth panel made bendable, the making bendable means being a sector piece provided on the shaft of a rotary roller which receives and transfers the blank taken out at a position corresponding to the sixth panel;

the infeeder including a carrier which moves together with the sixth panel of the cylindrical blank, and a prior bending block fixed to a position immediately before the mandrel, and as the carrier is moved downward, the sixth panel as well following the carrier to be bent with the corners of the forward end of the prior bending block; the heating station of the bottom forming means including a nozzle surface of a heat for heating the container bottom panel, and a bending claw provided on the nozzle surface for heating the inside surface of the third bottom panel, 2 pointed claws being erected toward the third bottom panel; and the press station of the bottom forming means pressing the container bottom from the outside and the inside by the forward side surface of the mandrel and a press surface, and including a triangular emboss provided on the forward side surface of the mandrel at a position corresponding to the sixth panel and abutting a position where the third bottom panel is exposed on the inside surface of the container, the blank being characterized in that the top of the paper container is roof-shaped.

Effects of the Invention

The invention of the above-described constitution makes the following operational functions and produced advantageous effect.

The packaging and filling device according to the present invention, the paper container provided by the packaging and filling device, and the blank used in the packaging and filling device form a paper container having 4 sidewalls and a substantially square cross-section, and a top and a bottom.

The paper container having the top of a roof-shaped configuration is a roof-shaped paper container and can be filled with liquid food, such as milk, juices, etc.

The paper container is formed of a blank prepared by cutting a band-shaped packaging material formed at least of an outermost thermoplastic layer, a paper layer and an innermost thermoplastic layer.

The outermost layer and the innermost layer are formed of a thermoplastic material, such as polyethylene, and are melted and softened by heating ti be heat-sealed by being pressed against each other.

The blank has a developed shape of the paper container and fold lines.

The blank is prepared by cutting the band-shaped packaging material in the developed shaped of the paper container and is vertically seals into the cylindrical body. The band-shaped packaging material is beforehand provided with the fold lines by forming linear embosses at the to-be-bent lines. In the present invention, a fold line is provided also at the border with the lower side of the third bottom panel, where the sixth panel is to be bent, whereby the bend of the sixth panel can be made easy.

The blank has a first bottom panel and a third bottom panel extended the respective lower sides of a first panel and a third panel which are one pair of 2 container sidewalls opposed to each other, and a second bottom panel and a fourth bottom panel extended from the respective lower sides of a second panel and a fourth panel which are the other pair of 2 container sidewalls opposed to each other. The third bottom panel has a sixth panel partially extended from the center of the lower side of the third bottom panel. The blank has a plurality of top panels corresponding to the top of the paper container.

The first panel, the second panel, the third panel and the fourth panel are jointed sequentially adjacent to each other, and by vertically sealing the first panel and the fourth panels, a cylindrical body having 4 sidewalls and a substantially square cross-section can be formed. For the vertical seal, the fifth panel extended from the side of the fourth panel can be provided.

The respective bottom panels are folded, and the container bottom can be formed. The respective upper panels are folded, and the top of the container can be formed.

As a characteristic of the present invention, the sixth panel has a width of 15-65%, preferably 20-60%, more preferably 30-55% of the total length of the lower side, and a height which facilitates the bend.

The sixth panel is bent and can protect the side surface of the third bottom panel at the center of lower side along a length corresponding to the width of the six panel without being exposed. As will be described below, the second bottom panel and the fourth bottom panel are formed into the lower side surfaces of the second and the fourth bottom panels faced outward and bent inward, and geometrically, only the center of the lower side of the third bottom panel is exposed on the inside of the container bottom. However, the packaging material is formed mainly of paper, and the exposed part is often widened, dislocated or deflected. The present invention is characterized in that the sixth panel has a large width which is 30-50% of the total length of the lower side of the third bottom panel, and can protect the side surface of the third bottom panel at the center of lower side in cases of widening, dislocation, deflection, etc. The container can be highly reliable.

In forming the bottom of the paper container, the sixth panel is bent outward, and the second bottom panel and the fourth bottom panel are formed into triangular flaps with the lower side surfaces of the second and fourth bottom panels faced outward and bent inward.

The six panel is bent outward, which can prevent the risk that the side surface of the sixth panel is exposed on the inside of the container.

The second bottom panel and the fourth bottom panels are formed into triangular flaps with the lower side surfaces of the second and the fourth bottom panel faced outward, and are bent inward, which can prevent the risk that the lower side surfaces of the second and the fourth bottom panels are exposed on the inside surface of the container.

In forming the bottom of the paper container, the first bottom panel and the third bottom panel are laid on the outside of the second bottom panel and the fourth bottom panel with the first bottom panel being outside the third bottom panel.

The outsides of the second bottom panel and the fourth bottom panel are covered by the first bottom panel and the third bottom panel, whereby the outer side surfaces of the second bottom panel and the fourth bottom panel can be protected by the first bottom panel and the third bottom panel. Furthermore, the first bottom panel is outside of the third bottom panel, whereby the respective side surfaces of the third bottom panel and the sixth panel are covered by the first bottom pane and protected. On the outside surface of the container bottom, only the minimum side surface, i.e., the lower side surface of the first bottom panel alone is exposed.

The outermost layer and the innermost layer are formed of a thermoplastic material, such as polyethylene or others, which permits the bottom to be pressed from the inside and the outside to be heat-sealed.

The packaging and filling device at least including a loading means of taking out 1 out of a bundle of a plurality of blanks having vertically sealed and flatted; a bottom forming means of forming the bottom of the cylindrical blank to form the container having the top opening and the bottom; a filling means of filling liquid food through the top opening; and a top sealing means of heat-sealing the top opening.

In the packaging and filling device, a blank, which is a material of the paper container, is supplied, the bottom is formed, a liquid is filled into the container, the top is sealed, and the paper container is manufactured.

The loading means takes out 1 blank out of a supplied bundle of a plurality of blanks vertically sealed and flattened.

The loading means supplies a bundle of a plurality of blanks vertically sealed and flattened. One flattened blank is taken out of a bundle of blanks, blanks. The blank taken out is formed cylindrical to be loaded to the next step.

The bottom forming means forms the bottom of the cylindrical blank, and the container having the top opening and the bottom is formed.

The bottom forming means specifically includes a plurality of mandrels radially provided on a rotary shaft; a mandrel is inserted into a container through the top opening; while the mandrel is intermittently rotated, the container bottom on the outer side of the mandrel is heated; the bottom panels are folded; the container bottom is pressed by the forward surface of the mandrel and the pressing surface from the outside and the inside; and the container having the top opening and bottom can be formed.

The filling means fills liquid food, such as milk, juices, etc., through the top opening.

The container has the sidewalls and the bottom already formed, and can be without failure filled with liquid food, such as mil, juices, etc.

The upper sealing means heats and press the top opening of the container, and can be heat sealed.

The packaging and filling device can include, as required, a sterilization means for sterilizes the inside surfaces and the inside of the container with a sterilization agent such as hydrogen peroxide liquid or others, or a high energy beam, such as ultraviolet ray, electron beam or others; a prior heating means for facilitating the heat-seal, a nitrogen gas replacing means for the upper void of the contained filled with liquid food, or others.

The loading means includes a taking means for taking out a blank and including a making bendable means for bending the sixth panel outward to make the sixth panel bendable; an erecting means for erecting a flat blank into cylindrical blank; and an infeeder for inserting the mandrel of the bottom forming means into the cylindrical blank with the sixth panel bendable.

The making bendable means of the loading means bends outward the sixth panel of the blank taken out and makes the sixth panel bendable. Making the sixth panel bendable ensures the bend of the sixth panel in a later step.

The sixth panel of the blank taken out is protruded out of the 2 stacked panels of the first bottom panel and the third bottom panel. The panel of the 2 stacked panels has high rigidity and is neither distorted nor deflected by the bending force applied to the sixth panel. The sixth panel is accurately bent by the bending force along the border with the panel of the 2 stacked panels, and the sixth panel can be made bendable.

The erecting means can erect cylindrical a flat blank.

In the infeeder, a mandrel of the bottom forming means is inserted into the cylindrical balk with the sixth panel made bendable.

The infeeder includes a carrier which moves together with the sixth panel of the cylindrical blank, and a prior bending block fixed to a position immediately before the mandrel, and as the carrier is moved downward, the sixth panel as well following the carrier to be bent with the corners of the forward end of the prior bending block.

There is a risk that the sixth panel made bendable by the making bendable means may return to the straight position in a following step. The infeeder can insert a mandrel of the bottom forming means into a cylindrical blank having the six panel made bendable.

The making bendable means is a sector piece provided on the shaft of a rotary roller which receives and transfers the blank taken out at a position corresponding to the sixth panel.

The flat blank taken out is received by the rotary roller and transferred to the next step. The rotary roller senses the position of a blank, rotates the roller and holds the blank together with the opposed roller to receive the blank.

On the shaft of the rotary roller, a sector piece is provided at a position corresponding to the sixth panel. The rotary roller rotates the roller and receives a blank, while rotating the sector piece on the shaft of the rotary roller to hit the sixth panel at the position corresponding to the sixth panel and can bend the sixth panel. The sixth panel can be made bendable.

The heating station of the bottom forming means including a nozzle surface of a heat for heating the container bottom panel, and a bending claw provided on the nozzle surface for heating the inside surface of the third bottom panel, 2 pointed claws being erected toward the third bottom panel.

The bending claws are provided on the nozzle surface. The bending claw has 2 pointed claws erected toward the third bottom panel. The forward ends of the claws abut the sixth panel surface made bendable, hot air passes between the claws and directly strikes the sixth panel surface to heat the sixth panel.

The sixth panel is bent by the bending claw and has the bend is fixed by the heating.

The press station of the bottom forming means pressing the container bottom from the outside and the inside by the forward side surface of the mandrel and a press surface, and including a triangular emboss provided on the forward side surface of the mandrel at a position corresponding to the sixth panel and abutting a position where the third bottom panel is exposed on the inside surface of the container.

The triangular flaps of the second and the fourth bottom panels makes a triangular step on the insider surface of the container. The triangular emboss is inserted in the triangular step to press the bent sixth panel, and strong seal can be formed.

As described above, the sixth panel can be accurately bent and the container bottom can be formed secure.

A packaging and filling device, paper container and blank which can make the sixth panel easily bendable up to the step of the bottom forming step and permit the bent portion to secure a length sufficient to protect the side surfaces of the packaging material can be provided.

BRIEF DESCRIPTION OF THE DRAWINGS

FIG. 1(A) is a plan view of the developed shape of a blank of the paper container, FIG. 1(B) is a plan view of the blank vertically sealed and flattened, FIG. 1(C) is the cylindrical blank, FIG. 1(D) is a perspective view of the empty container having the top opening opened and the bottom formed, and FIG. 1(E) is a perspective view of the paper container filled and sealed.

MODE FOR CARRYING OUT THE INVENTION

An embodiment of the present invention will be described below in good detail with reference to the attached drawings.

Figure 1:
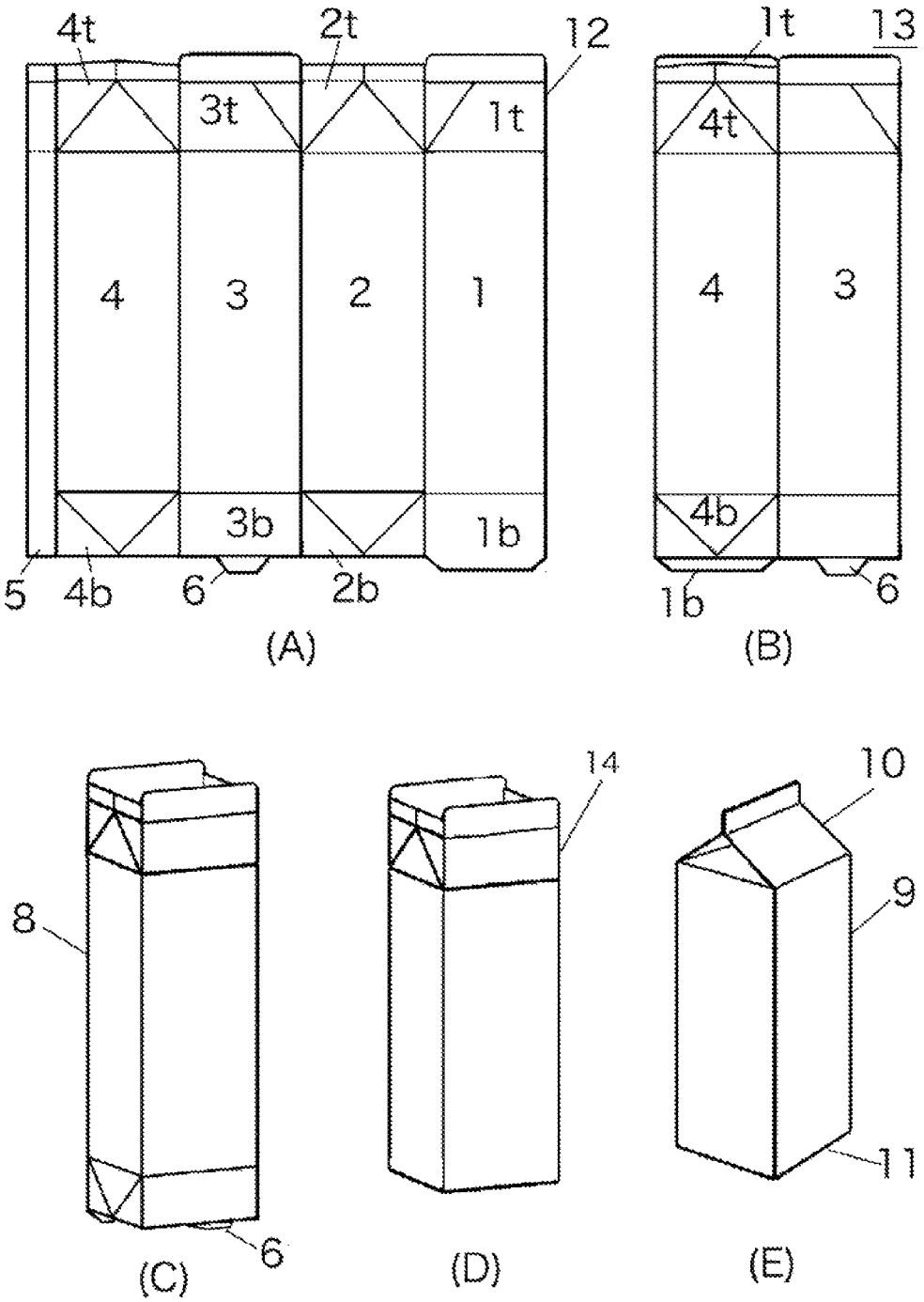
FIG. 1 illustrates the paper container usable in the present invention.

In this embodiment, a paper container 9 having, as illustrated in FIGS. 1(C) and 1(E), a cylindrical body 8 of a substantially square cross-section having 4 side walls, and a top 10 and a bottom 11 is formed.

The paper container having the top in a roofed configuration is a roof-shaped paper container, and can package and be filled with liquid food, such as milk, a juice or others.

The ordinary paper container of a capacity of 1 litter has the square one side of which is 73 mm and a height of 234 mm.

The paper container 9 is formed from a blank 12 prepared by cutting a band-shaped packaging material formed of an outermost thermoplastic layer, a paper layer and an innermost thermoplastic layer in the sequence of FIGS. 1(A), 1(B), 1(C), 1(D) and 1(E).

The outermost layer and the innermost layer are formed of a heat-sealable material for polyethylene, and are melted and softened by heating, and pressed on each other, and heat-sealed.

As illustrated in FIG. 1(A), the blank 12 has the developed shape of the paper container 9 and plural fold lines.

The blank 12 is formed by cutting the band-shaped packaging material (not illustrated) into the developed shape of the paper container 9. The blank 12 is vertically sealed into a cylindrical body. The fold lines are formed by linearly embossing the band-shaped packaging material in advance along the lines-to be-folded (the fold lines). In this embodiment, a fold line is provided at the boundary between the sixth panel 6 and the lower side of the third bottom panel 3*b*, where the sixth panel 6 is to be bent to thereby facilitate the bend of the sixth panel 6.

As illustrated in FIG. 1(A), the blank 12 has a first bottom panel 1*b* and a third bottom panel 3*b* extended from the respective lower sides of a first panel 1 and a third panel 3 which correspond to one pair of 2 opposed container sidewalls, and a second bottom panel 2*b* and a fourth bottom panel 4*b* extended from the respective lower ends of a second panel 2 and a fourth panel 4 which correspond to the other 2 opposed container sidewalls; the sixth panel 6 partially extended from the center of the lower side of the third bottom panel 3*b*; and plural panels 1*t*, 2*t*, 3*t*, 4*t* which correspond to the top 10 of the container 9.

As illustrated in FIG. 1(A), the first panel 1, the second panel 2, the third panel 3 and the fourth panel 4 are jointed adjacent to each other in the described sequence. The first panel 1 and the fourth panel 4 are vertically sealed to thereby form a cylindrical body having 4 sidewalls and a substantially square cross-section. For the vertical seal, a fifth panel 5 is provided, extended from the side of the fourth panel.

FIG. 1(B) illustrates the blank 13 in the cylindrical body having the fifth panel 5 vertically sealed, which is flattened.

Figure 3:
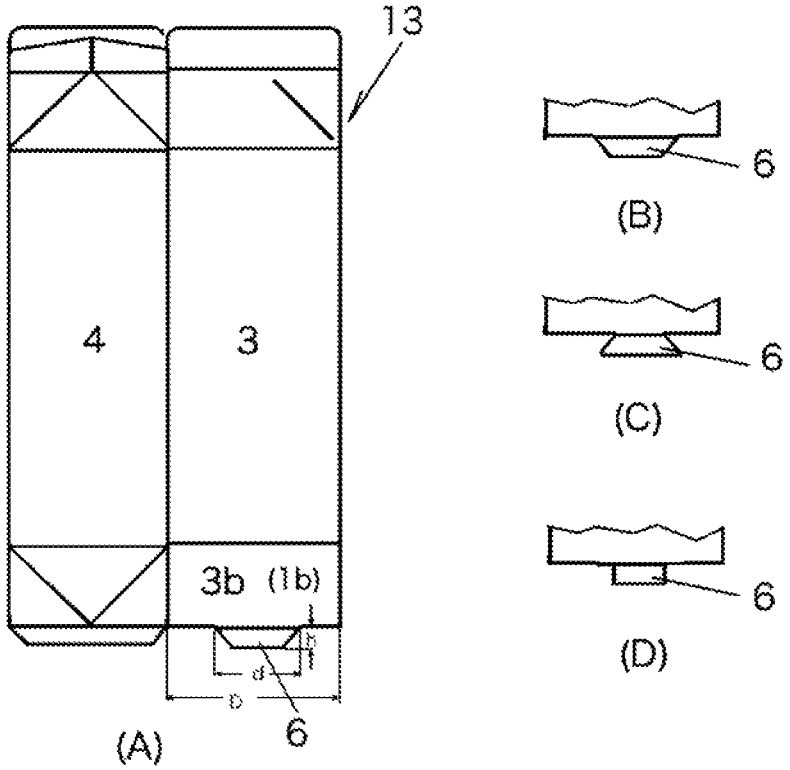
FIG. 3 is a plan view of the blank usable in the present invention vertically sealed and flattened (A) and partial plan views of variations of the sixth pane (B), (C) and (D).

This embodiment is characterized in that as illustrated in FIG. 3(A), the sixth panel 6 has a width which is 15-65% of a total length of the lower side of the third bottom panel, preferably 20-60%, more preferably 30-55%, and a height h which facilitates the bend.

The specific dimensions of the sixth panel 6 depend on the container capacity (1 side of the container). For example, when one side is 73 mm, the width is, e.g., 20-40 mm. When the width is below the lower limit value excluding the lower limit value, there is a risk that the side surface at the center of the lower side of the third bottom panel 3*b* might be exposed. On the other hand, when the width is over the upper limit value, the length to be bent becomes long, and the sixth panel 6 cannot be bent easily.

The six panel 6 is bent to thereby protect the side surface at the center of the lower side of the third bottom panel 3 along the distance corresponding to the width of the sixth panel 6.

The shape and the dimensions of the sixth panel 6 is exemplified in FIGS. 3(B), 3(C) and 3(D). The shape of the sixth panel 6 is trapezoid, inverse trapezoid, rectangle or others. The shape can be suitably selected and changed.

The height h of the sixth panel 6 is a height which permits the sixth panel 6 to be easily bent by the prior bending means (making bendable means) in the packaging and filling device and depends on the specifications of the prior bending member (making bendable means).

Figure 2:
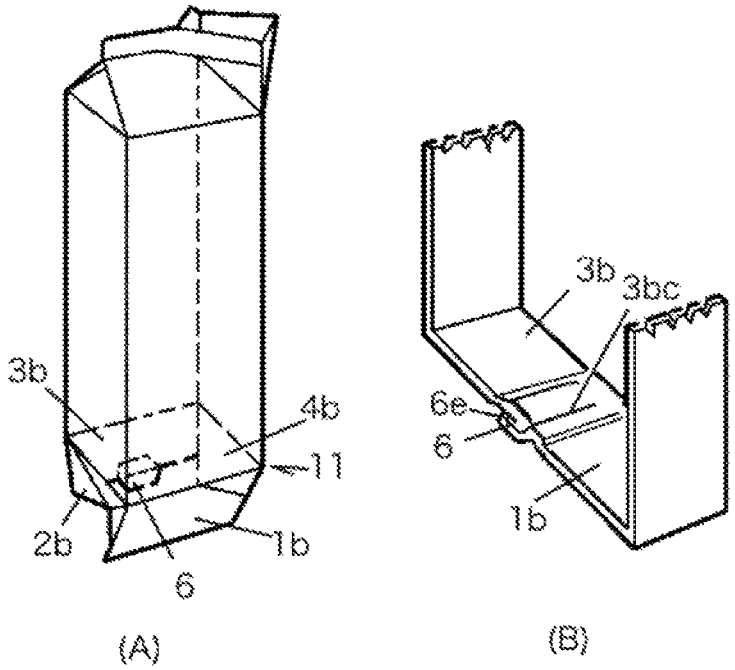
FIG. 2 is perspective views of the paper container usable in the present invention having the top opened and the bottom dissolved (A) and the vertical section of the bottom (B).

As illustrated In FIG. 2(A), the second bottom panel 2*b* and the fourth bottom panel 4*b* are formed into triangular flaps with the lower side surfaces faced outward, and bent inward.

Figure 4:
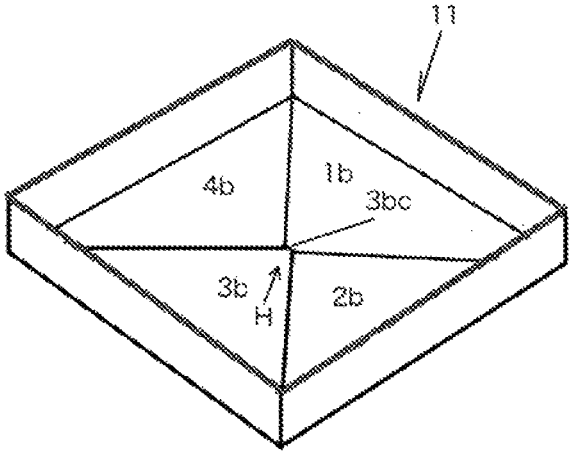
FIG. 4 is a perspective view of the bottom of the sectioned paper container usable in the present invention.

As illustrated in FIGS. 4 and 2(B), on the inside of the container bottom surface 11, according to the design, only the central bottom side surface 3*bc* of the third bottom panel 3*b* is exposed. Because of the packaging material made mainly of paper, actually, the exposed part enlarges, and often is dislocated or deflected. This embodiment is characterized in that the central lower end 3*bc* has the width of 30-50% of the total length of the lower side of the third bottom panel 3*b* and can allow for the enlargement, dislocation, the deflection, etc. described above.

As illustrated in FIG. 2(A), the bottom 11 of the paper container is formed by bending the sixth panel 6 outward and forming the second bottom panel 2*b* and the fourth bottom panel 4*b* into triangular flaps with the lower side surfaces of the second and the fourth bottom panels 2*b*, 4*b* faced outward and bending inward the second bottom panel 2*b* and the fourth bottom panel 4*b*.

The sixth panel is bent outward, whereby as illustrated in FIG. 2(B), there is no risk that the side surface 6*e* of the sixth panel 6 is exposed inside the container.

As illustrated in FIG. 2(A), in forming the bottom 11 of the paper container, the first bottom panel 1*b* and the third bottom panel 3*b* are so laid on the outsides of the second bottom panel 2*b* and the fourth bottom panel 4*b* that the first bottom panel 1*b* is on the outside of the third bottom panel 3*b*.

The outsides of the second bottom panel 2*b* and the fourth bottom panel 4*b* are covered by the first bottom panel 1*b* and the third bottom panel 3*b*, whereby the side surfaces of the outsides of the second bottom panel 2*b* and the fourth bottom panel 4*b* are protected by the first bottom panel 1*b* and the third bottom panel 3*b*. Furthermore, the first bottom panel 1*b* is outside the third bottom panel 3*b*, whereby the respective side surfaces of the third bottom panel 3*b* and the sixth panel 6 are covered and protected by the first bottom panel 1*b*. On the outside surface of the container bottom, the lower side surface alone of the first bottom panel is exposed on the outside of the container.

Figure 12:
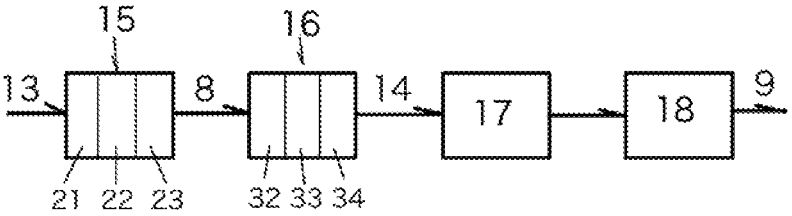
FIG. 12 is a schematic view of an example of the packaging and filling device usable in the present invention.

As illustrated in the schematic view of FIG. 12, the packaging and filling device according to this embodiment comprises a loading means 15 which takes out 1 blank 13 out of a supplied bundle of a plurality of vertically sealed and flattened blanks and loads the cylindrical blank 8; a bottom forming means 16 which forms the bottom of the cylindrical blank 8 to prepare a container 14 having the top opening and the bottom; a filling means 17 which fills liquid food through the top opening; and a top sealing means 18 which heat-seals the top opening.

In the packaging and filling device, a blank 13 of a cylindrical body of a paper container material, which is vertically sealed and flattened is loaded, the container bottom 11 is formed, a liquid is filled in the container, and the top is heat-sealed to manufacture a paper container 9.

The loading means 15 takes out 1 blank 13 out of a supplied bundle 20 of a plurality blanks vertically sealed and flattened and loads the cylindrical blank 8 in the bottom forming means 16.

The loading means 15 includes a taking-out means having a making foldable means which takes put a blank 13 and bending the sixth panel 6 outward to make the sixth panel 6 foldable; an erecting means 22 which erects the flattened blank into a cylindrical blank; an infeeder 23 which inserts the cylindrical blank having the sixth panel made foldable into the mandrel of the bottom forming means.

The taking-out means 21 supplies a bundle of a plurality of vertically sealed and flattened blanks and taking out 1 flattened blank out of the bundle 20 of blanks, blanks.

The making foldable means of the taking out means 21 bending outward the sixth panel of the balk taken out to make the sixth panel foldable. Making the sixth panel foldable ensures the accurate fold of the sixth panel in a later step.

As illustrated in FIG. 3(A), the sixth panel 6 taken out protrudes out of the panel of the 2 stacked sheets of the first bottom panel 1*b* and the third bottom panel 3*b*. The panel of the 2 stacked panels has such a high rigidity that the 2 stacked panels 1*b*, 3*b* are neither distorted nor deflected due to the bending force applied to the sixth panel 6. The sixth panel 6 is bend by the bending force accurately along the border (fold line) between itself and the panel of the 2 stacked panels, and the sixth panel is made foldable.

Figure 5:
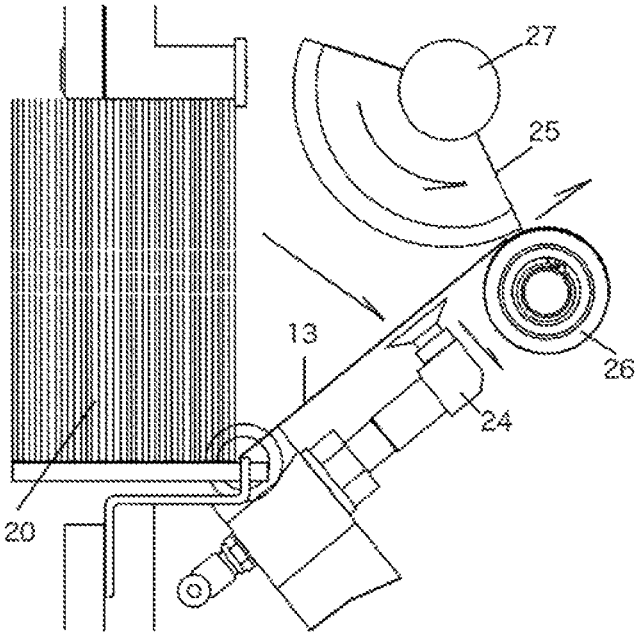
FIG. 5 is a diagrammatic view which illustrates the loading means taking out, receiving and transferring a blank.
Figure 6:
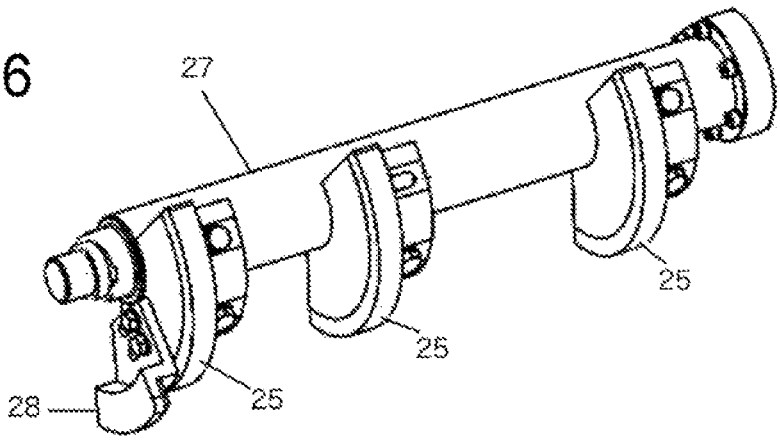
FIG. 6 is a partial perspective view of the making bendable means provided on the rotary roller for receiving and transferring a blank.

The taking-out means 21, and the making foldable means (not illustrated in FIG. 5) are described with reference to FIGS. 5 and 6.

The taking-out means 21 includes a suction means 24 which suctions and falls down 1 blank 13 from a bundle 20 with the suction force; and a circular roller 25 and the opposed roller 26 which pinches the edge of the blank 13 to carry the blank 13. In this embodiment, 3 circular rollers 25 are provided on the axis 27 of the rotary roller.

In this embodiment, the making foldable means 28 is a sector piece 28 provided on the axis of the rotary roller which receives and carries the flattened blank taken out and at the position corresponding to the sixth panel.

The flattened blank 13 taken out is received by the rotary roller 25 and carries to the next step. The rotary roller 25 senses the position of the blank and rotates the roller to receive the blank, holding the blank together with the opposed roller 26.

On the axis 27 of the rotary roller 25, the sector piece 28 is provided at the position corresponding to the sixth panel. The rotary roller 25 rotates the roller to receive the blank 13 while rotating also the sector piece 28 of the rotary roller, and at the position corresponding to the sixth panel, the sector piece 28 hits the sixth panel and bends the sixth panel to make the sixth panel foldable.

the erecting means 22 erects the flattened blank 13 to the cylindrical blank 8 as illustrated in FIG. 1(C).

The infeeder 23 inserts the cylindrical blank 8 with kept the sixth pane foldable into the mandrel of the bottom forming means 16.

There is a risk that the sixth panel made foldable by the making foldable means might restore the straight position in a following step. The infeeder 23 inserts the cylindrical blank 8 with the six panel kept foldable into the mandrel of the bottom forming means 16.

Figure 7:
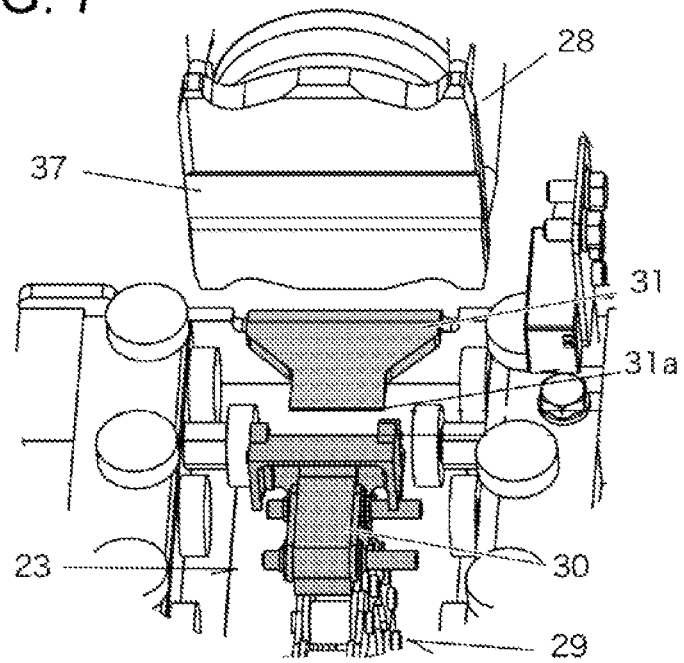
FIG. 7 is a perspective view of the forward end of the infeeder usable in the present invention illustrating making the sixth panel bendable.

The perspective view of FIG. 7 illustrates the sixth panel being made foldable at the forward end of the infeeder 23 of this embodiment.

The forward end of the feeder conveyor 29 of the infeeder 23 opposed to the mandrel 28 of the bottom forming means 16 is illustrated. In the prior bending mechanism, a carrier provided on the feeder conveyor 29. A cylindrical blank 8 (not illustrated in FIG. 7) is positioned before the carrier 30 of the feeder conveyor 29, and as the cylindrical blank 8 is moved along the feeder conveyor 29, the carrier 30 follows the cylindrical blank 8. A prior bending block 31 is fixedly provided further ahead of the feeder conveyor 29. The prior bending block 31 is positioned immediately ahead of the mandrel 28 so that the cylindrical blank 8 is transferred from the forward end of the feeder conveyor 29. As the cylindrical blank 8 is transferred to the mandrel 28, the feed conveyor 29 descends downward to return to the original position, and resultantly, the carrier 30 as well starts to move downward. As the carrier 30 passes the prior bending block 31, a narrow clearance is defined between the forward end of the carrier 30 and the forward end of the prior bending block 31. As the carrier 30 shifts downward, the fifth panel 6 also follows, and the forward corner 31*a* of the prior bending block 31 bends the sixth panel 6 to keep the sixth panel bendable. The feeder conveyor 29 is further moved, and the carrier 30 departs the mandrel 28 and the six panel 6.

The bottom forming means 16 forms the bottom of the cylindrical blank, and a container 14 having the opening and the bottom.

The bottom forming means 16, in this embodiment, has a plurality of mandrels provided radially on a rotary shaft. The mandrels are engaged into the containers through the top openings; while the mandrels are intermittently rotated, the bottoms of the containers on the outer ends of the mandrels are heated by a heat station 32; the bottom panels are folded by a panel folding station 33; and the container bottoms are pressed from both the inside and the outside by the forward end surfaces of the mandrels and the press surfaces, and the containers 14 respectively having the top openings and the bottoms are formed.

The bottom forming means 16 transfers blanks by a rotary mandrel assembly having a plurality of mandrels radially directed outward.

The mandrels are turned to the heating station 32 to heat the bottom panels of the blanks by a suitable heating device. This heating device blows hot blast through a nozzle to the bottom panels. The mandrels are turned to the next panel folding station 33 to bent the bottom panels, and at a press station 34, the sealed bottom walls of the containers are formed.

The heater for heating the bottom panels of a container of the heating station 32 of the bottom forming means 16 will be described with reference to FIG. 8 which illustrates a perspective view of the nozzle.

An inner nozzle 35*a* and an outer nozzle 35*b* of the heater respectively blast hot air to the inside surfaces and the outside surfaces of the bottom panels (not illustrated in FIG. 8) to heat them.

The heater approaches the forward end of the mandrel so that the bottom panel are engaged in the gap between the inner nozzle 35*a* and the outer nozzle 35*b* assembled.

Figure 8:
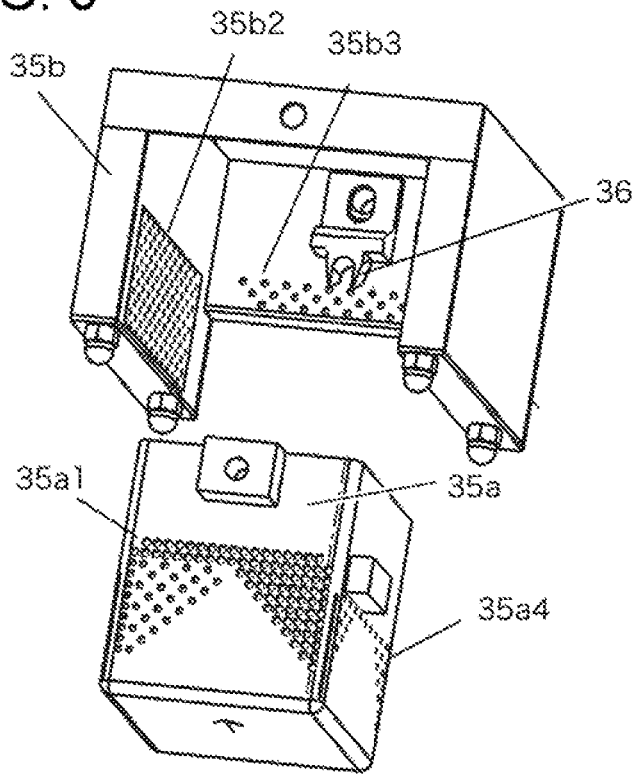
FIG. 8 is a dissolved perspective view of the inside and the outside nozzles of the heater for heating the container bottom panel at the outer end of the mandrel of the bottom forming means usable in the present invention.

In FIG. 8, the inner nozzle 35*a*1 heats the inside surface of the first bottom panel 1*b*; the inner nozzle 35*a*4 heats the inside surface for the fourth bottom panel 4*b*; the outer nozzle 35*b*2 heats the outer surface of the second bottom panel 2*b*; and the outer nozzle 35*b*3 heats the inside surface of the third bottom panel 3*b*.

In this embodiment, a bending claw 36 is provided on the top of the outer nozzle 35*b*3. The bending claw 36 erects 2 sharp claws directed toward the third bottom panel 3*b*. The forward ends of the claws abut the surface of the sixth panel made bendable, and hot air passes between the claws and is applied directly to the surface of the sixth panel to heat the sixth panel.

The sixth panel is bent by the bending claw 36 and has the bend fixed by the heating.

Folding of the bottom panels toward the mandrel forward surface 37 at a panel forming station 33 will be described with reference to FIGS. 8 and 10.

Figure 9:
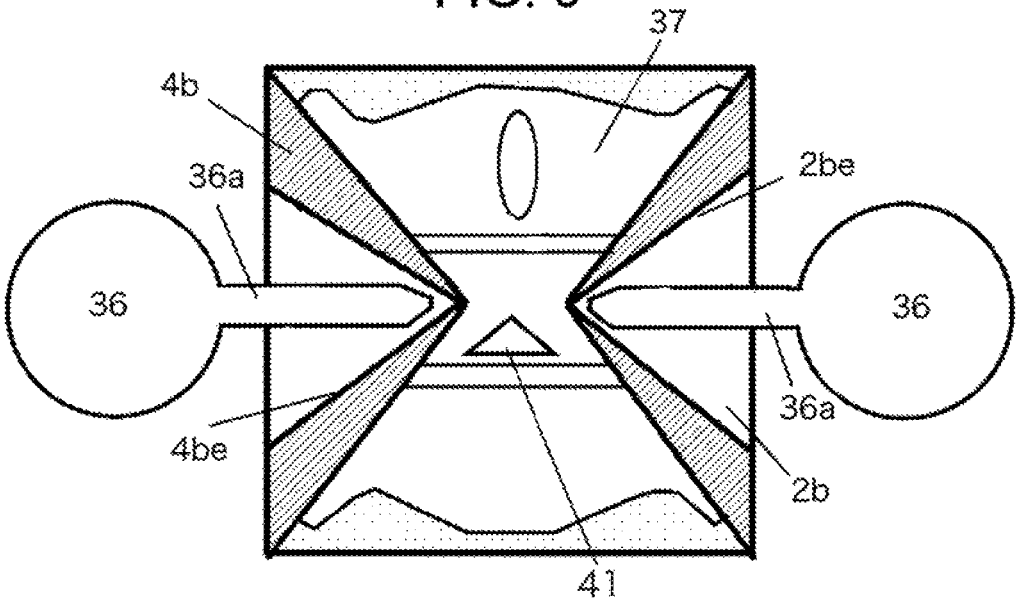
FIG. 9 is a diagrammatic plan view of the bottom forming means usable in the present invention folding the first and the third bottom panels.

In FIG. 9, the second bottom panel 2*b* and the fourth bottom panel 4*b* are formed into triangular flaps by the arms 36*a*, 36*a* of a second fourth panel folding members 36, 36 into triangular flaps with the lower end surfaces 2*be*, 4*be* of the second and the fourth bottom panels 2*b*, 4*b* faced outward and are bent inward by the arms 361, 36*b* of a second fourth panel folding members 36, 36.

In FIG. 9, the first bottom panel 1*b* and the third bottom panel 3*b* are not illustrated.

Before the folding of the second bottom panels 2*b* and the fourth bottom panel 4*b* finishes, the folding of the first bottom panel 1*b*, the third bottom panel 3*b* and the sixth panel is started.

Figure 10:
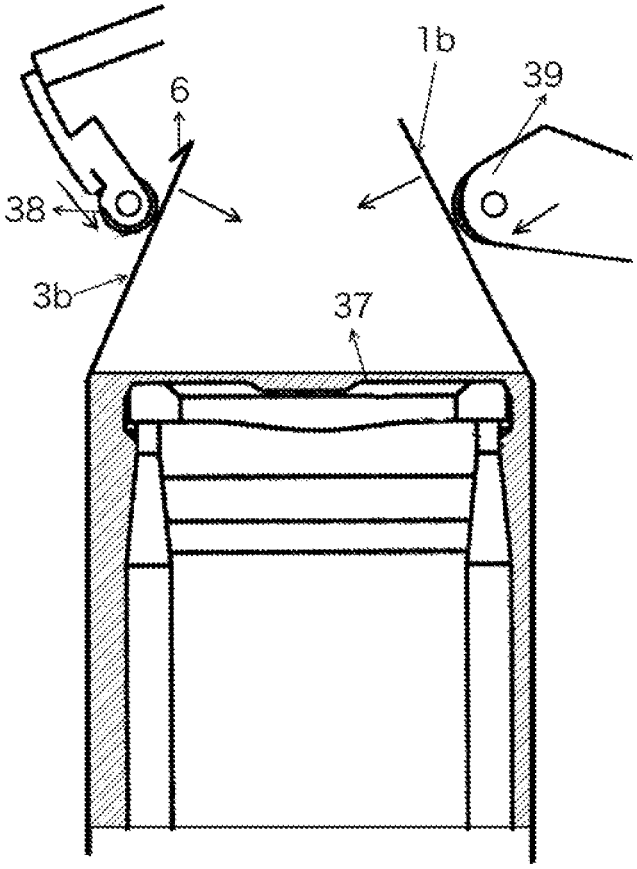
FIG. 10 is a partial vertical sectional view of the bottom forming means usable in the present invention folding the first and the third bottom panel.
Figure 11:
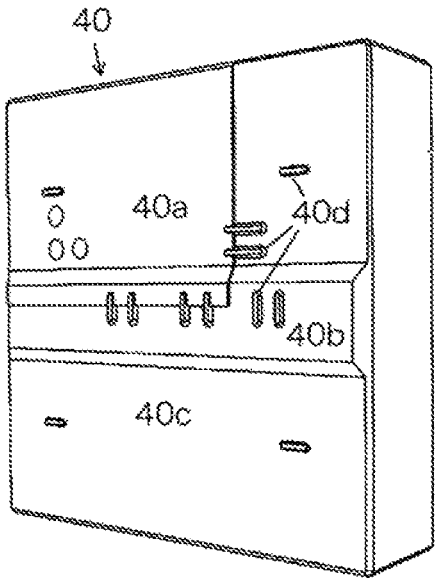
FIG. 11 is a perspective view of a press surface for pressing the container bottom from the outside by the bottom forming means usable in the present invention.

In FIG. 10, the first and the third bottom panels 1*b*, 3*b* are folded by the first panel folding member 36 and the third panel folding member 38 of the bottom forming means. FIG. 10 does not illustrate the second bottom panel and the fourth bottom panel.

In this embodiment, the six panel has been already bent forward by the prior benign mechanism.

The third bottom panel 3*b* is laid on the outsides of the second bottom panel 2*b* and the fourth bottom panel 4*b* (not illustrated in FIG. 10) by the third panel folding member 38 so that the first bottom panel 1*b* is outside of the third bottom panel 3*b*.

The first bottom panel 1*b* is folded by the first panel folding member 39 so that the first bottom panel 1*b* is laid on the outside of the third bottom panel 3*b*.

The outsides of the second bottom panel 2*b* and the fourth bottom panel 4*b* are covered by the first bottom panel 1*b* and the third bottom panel 3*b*. The respective side surfaces of the third bottom panel 3*b* and the sixth panel 6 are covered by the first bottom panel 1*b*.

In the press station 34 of the bottom forming means 16, the container bottom 11 is pressed from the outside and the inside thereof by the mandrel forward side surface 37 and the press surface 40.

In this embodiment, the press surface 40 includes a plane 40*a* opposed to the outside surface of the first bottom plane 1*b*, a plane 40*a* opposed to the outside surface of the first bottom panel 1*b*, a plane 40*c* opposed to the outside surface of the third bottom panel 3*b*, a projected surface 40*b* having a flat top surface for forming a trench in the container bottom 11, and a plurality of embosses 40*d*.

On the other hand, as illustrated in FIG. 9, the mandrel forward surface has a triangular emboss 41 at the position opposed to the bent sixth panel and at the inside surface of the container.

As illustrated in FIG. 4, the triangular flaps of the second and the fourth bottom panels 2*b*, 4*b* form a triangular step H on the inside surface of the container. The triangular emboss 42 is inserted in the triangular step H and presses the bent sixth panel to form a strong seal.

In this embodiment, the filling means 17 fills liquid food, such as milk, juices, etc., into the container through the opening.

The container has the side walls and the bottom already formed.

In this embodiment, an upper sealing means 18 the top opening of the container 10 is heated and pressed to be heat-sealed.

The packaging and filling device comprises a sterilization means of sterilizing the inside surface and the inside of the container with a sterilization agent, such as hydrogen peroxide liquid or others, or a high energy beam, such as ultraviolet ray, electron beam or others; a prior heating means which facilitates the heat-seal; and a nitrogen gas replacing means which fills nitrogen gas into the upper void of the container filled with liquid food.

In this embodiment, the sixth panel is accurately bent to secure the container bottom.

This embodiment provides a packing/filling device, a paper container and a blank which makes the sixth panel easily bendable prior to the bottom forming step, and enables the bent portion to ensures a sufficient length necessary to protect the side surface of the packaging material.

The present invention is not limited to the embodiment described above and can be variously modified, based on the aims of the present invention, and the modifications and the variations are excluded from the scope of the present invention.

INDUSTRIAL APPLICABILITY

The present invention is applicable to the manufacture of packaging/filling liquid food.

REFERENCE NUMBERS

1 first panel
2 second panel
3 third panel
4 fourth panel
6 sixth panel
9 paper container
12, 13 blank

What is claimed is:

1. A packaging and filling device for forming a paper container, the paper container comprising a cylindrical body having a substantially square cross section, four sidewalls, a top, and a bottom, wherein the paper container is formed of a blank prepared by cutting a band-shaped packaging material including an outermost thermoplastic layer, a paper layer, and an innermost thermoplastic layer, the blank further comprising:

a first panel and a third panel, the first and third panels being configured to form a first pair of opposing sidewalls of the container;

a second panel and a fourth panel, the second panel and fourth panels being configured to form a second pair of opposing sidewalls of the container;

a first bottom panel and a third bottom panel, the first and third bottom panels extending from the respective lower sides of the first panel and the third panel;

a second bottom panel and a fourth bottom panel, the second and fourth bottom panels extending from the respective lower sides of the second panel and the fourth panel; and a plurality of top panels corresponding to the top of the paper container;

wherein:

the third bottom panel comprises a sixth panel partially extended from a center of the lower side of the third bottom panel; and a width of the sixth panel is 15-65% of a total length of the lower side of the third bottom panel;

wherein the bottom of the paper container is formed by:

bending the sixth panel outward;

bending the second bottom panel and the fourth panel into triangular flaps with the lower side surfaces of the second and the fourth bottom panels facing outward, and bending the second and the fourth bottom panels inward;

stacking the first bottom panel and the third bottom panel on the outsides of the second bottom panel and the fourth bottom panel with the first bottom panel positioned outside of the third bottom panel; and pressing from the inside and the outside of the paper container; and heat-sealing to form a seal;

the packaging and filling device further comprising:

a loading unit configured to extract a selected blank from a bundle of a plurality of vertically sealed and flattened blanks;

a bottom forming unit configured to form the bottom of a cylindrical blank to form the container having a top opening and the bottom;

a filling unit configured to fill liquid food through the top opening; and a top sealing unit configured to heat-seal the top opening;

wherein the loading unit further comprises:

an extracting unit configured to extract the blank, the extracting unit including a bendable unit which bends the sixth panel outward to make the sixth panel bendable;

an erecting unit configured to erect the flattened blank into the cylindrical blank; and an infeeder which inserts a mandrel of the bottom forming unit into the cylindrical blank with the sixth panel made bendable, wherein:

the bendable unit is a sector piece provided on a shaft of a rotary roller which receives and transfers the extracted blank, the sector piece being provided at a position corresponding to the sixth panel; and the infeeder comprises:

a carrier which moves together with the sixth panel of the cylindrical blank; and a prior bending block fixed to a position immediately before the mandrel;

wherein as the carrier is moved downward, the sixth panel follows the carrier to be bent with the corners of the forward end of the prior bending block;

wherein the bottom forming unit comprises:

a heating station configured to heat the container bottom, the heating station comprising:

a nozzle surface for heating the container bottom; and bending claws provided on the nozzle surface for heating an inside surface of the third bottom panel, the bending claws including two pointed claws erected toward the third bottom panel; and a press station configured to press the container bottom from the outside and the inside of the container by a forward side surface of the mandrel and a press surface, the press station comprising a triangular emboss provided on the forward side surface of the mandrel at a position corresponding to the sixth panel and abutting a position where the third bottom panel is exposed on the inside surface of the container, whereby the sixth panel is bent, and the container bottom is formed.

2. A packaging and filling device for forming a paper container from a blank, comprising:

a loading unit comprising:

an extracting unit configured to extract a blank from a plurality of vertically sealed and flattened blanks, the blank including first, second, third, and fourth bottom panels, the third bottom panel comprising a sixth panel partially extended from a center of the lower side of the third bottom panel; and a bendable unit configured to bend the sixth panel outward and make the sixth panel bendable;

an erecting unit configured to erect the flattened blank into a cylindrical blank;

an infeeder configured to insert a mandrel into the cylindrical blank with the sixth panel made bendable;

a bottom forming unit configured to form a bottom of the cylindrical blank to form the paper container having a top opening and a bottom, the bottom forming unit comprising the mandrel, a press station and a heating station;

a filling unit configured to fill liquid food through the top opening; and a top sealing unit configured to heat-seal the top opening; wherein:

the bendable unit includes a sector piece provided on a shaft of a rotary roller which receives and transfers the extracted blank, the sector piece being provided at a position corresponding to the sixth panel;

the infeeder comprises:

a carrier which moves together with the sixth panel of the cylindrical blank; and a prior bending block fixed to a position immediately before the mandrel;

wherein as the carrier is moved downward, the sixth panel follows the carrier to be bent with the corners of the forward end of the prior bending block;

the heating station of the bottom forming unit comprises:

a nozzle surface of a heater for heating the container bottom; and a bending claw provided on the nozzle surface for heating the inside surface of the third bottom panel, the bending claw including pointed claws erected toward the third bottom panel; and the press station of the bottom forming unit presses the container bottom from the outside and the inside of the container by a forward side surface of the mandrel and a press surface, the press station comprising a triangular emboss provided on the forward side surface of the mandrel at a position corresponding to the sixth panel and abutting a position where the third bottom panel is exposed on the inside surface of the container.

* * * * *